US008109652B2

(12) United States Patent
Chen

(10) Patent No.: US 8,109,652 B2
(45) Date of Patent: Feb. 7, 2012

(54) LED ASSEMBLY

(76) Inventor: Ya-Huei Chen, Taipei (TW)

( * ) Notice: Subject to any disclaimer, the term of this patent is extended or adjusted under 35 U.S.C. 154(b) by 335 days.

(21) Appl. No.: 12/400,923

(22) Filed: Mar. 10, 2009

(65) Prior Publication Data

US 2009/0244909 A1 Oct. 1, 2009

(30) Foreign Application Priority Data

Apr. 1, 2008 (TW) ..... 97205526 U
Jun. 6, 2008 (TW) ..... 97209964 U

(51) Int. Cl.
*F21S 4/00* (2006.01)
*F21V 21/005* (2006.01)
*F21V 21/34* (2006.01)

(52) U.S. Cl. ..... 362/249.02; 362/373; 362/800; 362/218; 362/264; 362/230

(58) Field of Classification Search ..... 362/249.02, 362/800, 543–545, 227, 230, 231, 373, 294, 362/218, 646, 264, 345; 257/81–83, 88, 257/89, 99, 100, 684, 734, 737; 313/498; 439/214–216
See application file for complete search history.

(56) References Cited

U.S. PATENT DOCUMENTS 6,943,433 B2 * 9/2005 Kamada ..... 257/666
7,218,041 B2 * 5/2007 Isoda ..... 313/11
7,344,296 B2 * 3/2008 Matsui et al. ..... 362/652
7,456,499 B2 * 11/2008 Loh et al. ..... 257/710
7,527,391 B2 * 5/2009 Wu ..... 362/257
7,588,362 B2 * 9/2009 Park et al. ..... 362/612
7,862,195 B2 * 1/2011 Stack et al. ..... 362/125
2003/0103347 A1 * 6/2003 Friend ..... 362/225
2004/0233672 A1 * 11/2004 Dubuc ..... 362/294
2005/0082965 A1 * 4/2005 Huang et al. ..... 313/498
2006/0187660 A1 * 8/2006 Liu ..... 362/294
2008/0106892 A1 * 5/2008 Griffiths et al. ..... 362/223

* cited by examiner

*Primary Examiner* — Anabel Ton
*Assistant Examiner* — Danielle Allen
(74) *Attorney, Agent, or Firm* — Ming Chow; Sinorica, LLC

(57) ABSTRACT

An improved LED assembly comprises a frame and a circuit substrate. The frame has a slot, which has an opening on the upper surface of the frame. An elongated inverted L-shaped structure is formed on either side of the opening, and one or more conductive strips are formed on the inner side of the elongated inverted L-shaped structure. Therefore, electricity may be supplied to the conductive strips of the frame. In assembly, the circuit substrate is slid into the slot of the frame so that each of the conductive strips of the circuit substrate is engaged with the corresponding conductive strip of the frame. Therefore, electricity from the electric source may be fed from the source through the conductive strip of the frame and the conductive strip of the circuit substrate and then to the light-emitting units so that each of the light-emitting units may be powered up.

16 Claims, 11 Drawing Sheets

LED ASSEMBLY

BACKGROUND OF THE INVENTION

1. Field of the Invention

The invention generally relates to an LED assembly. More particularly, the invention relates to an improved LED assembly that light-emitting units may be lit up after the circuit substrate is fitted onto the frame.

2. Description of the Prior Art

LED has the advantages of long service life, high energy efficiency, durability, resistance to vibrations, reliability, compactness, fast response and the fact that it may be massively produced. Therefore, LED has been used for the purpose of illumination. However, more heat is generated by LED when it is lit; therefore, a heat-dissipating module must be used to dissipate the heat into the ambient air. Whence, such heat-dissipating module is an indispensable part of an LED assembly.

The LED assembly of the prior art has the following two disadvantages in assembling:

1. In the prior art, LEDs are first disposed on an aluminum substrate and then the aluminum substrate is fastened onto a heat-dissipating module by screws or glue. Therefore, longer time is needed in manufacturing and cost of manufacturing is higher.

2. Also, each LED has to be electrically connected with a power source. Such connection takes longer time.

From the above, we can see that the LED assembly of the prior art has many disadvantages and needs to be improved.

To eliminate the disadvantages of the LED assembly of the prior art, the inventor has put in a lot of effort in the subject and has successfully come up with the improved LED assembly of the present invention.

SUMMARY OF THE INVENTION

The first object of the present invention is to provide an improved LED assembly comprising a frame and a circuit substrate. The frame has a slot, and one or more conductive strips that are formed on the inner side of the elongated inverted L-shaped structure of the frame. The conductive strips are connected with a power source and may be engaged with the conductive strips disposed on the circuit substrate. In assembly, the circuit substrate is slid into the slot of the frame so that each of the conductive strips of the circuit substrate is engaged with the corresponding conductive strip of the frame. Therefore, electricity from the electric source may be fed from the source through the conductive strip of the frame and the conductive strip of the circuit substrate and then to the light-emitting units so that each of the light-emitting units may be powered up and emit light. Consequently, the goal of easy and fast assembly may be reached.

The second object of the present invention is to provide an improved LED assembly that has the advantages of simple structure, easy assembly and high usefulness.

To reach these objects, an improved LED assembly is disclosed. The improved LED assembly comprises a frame and a circuit substrate. The frame has a slot, which has an opening on the upper surface of the frame. An elongated inverted L-shaped structure is formed on either side of the opening, and one or more conductive strips are formed on the inner side of the elongated inverted L-shaped structure. Therefore, electricity may be supplied to the conductive strips of the frame. The conductive strips of the frame are of the form of leaf spring or flexible strip. Also, the positive prongs and negative prongs of the light-emitting units are connected to the conductive strips of the circuit substrate through connective wire or circuit design. In assembly, the circuit substrate is slid into the slot of the frame so that the light-emitting units are moved into the opening and are fully exposed and each of the conductive strips of the circuit substrate is engaged with the corresponding conductive strip of the frame. Therefore, electricity from the electric source may be fed from the source through the conductive strip of the frame and the conductive strip of the circuit substrate and then to the light-emitting units so that the light-emitting units disposed on each circuit substrate may be lit. Consequently, the goal of fast assembly may be reached.

These features and advantages of the present invention will be fully understood and appreciated from the following detailed description of the accompanying drawings.

DETAILED DESCRIPTION OF THE PREFERRED EMBODIMENT

Figure 1:
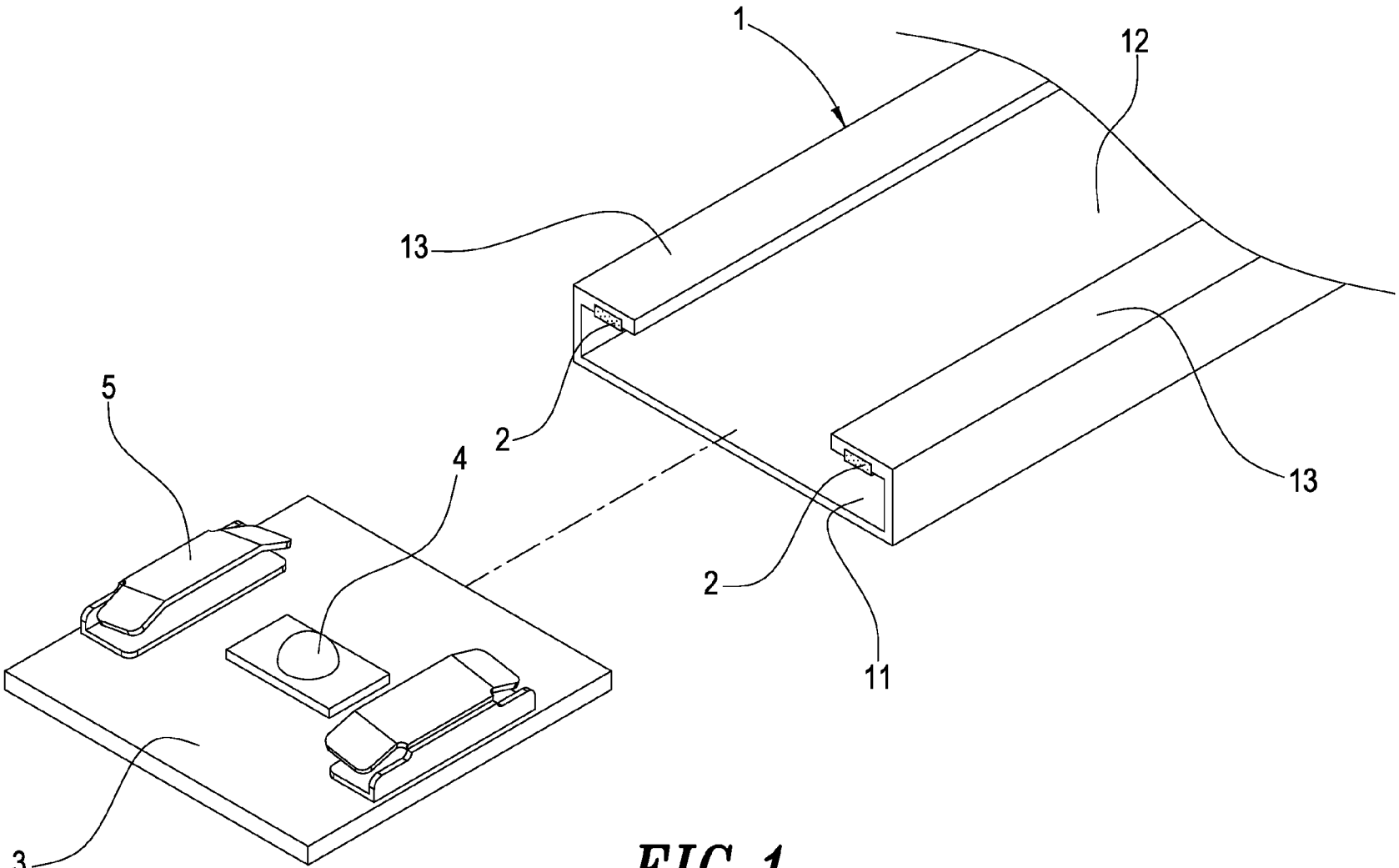
FIG. 1 is a perspective view showing the first embodiment of the LED assembly of the present invention and illustrating how the circuit substrate is fitted onto the frame.
Figure 2:
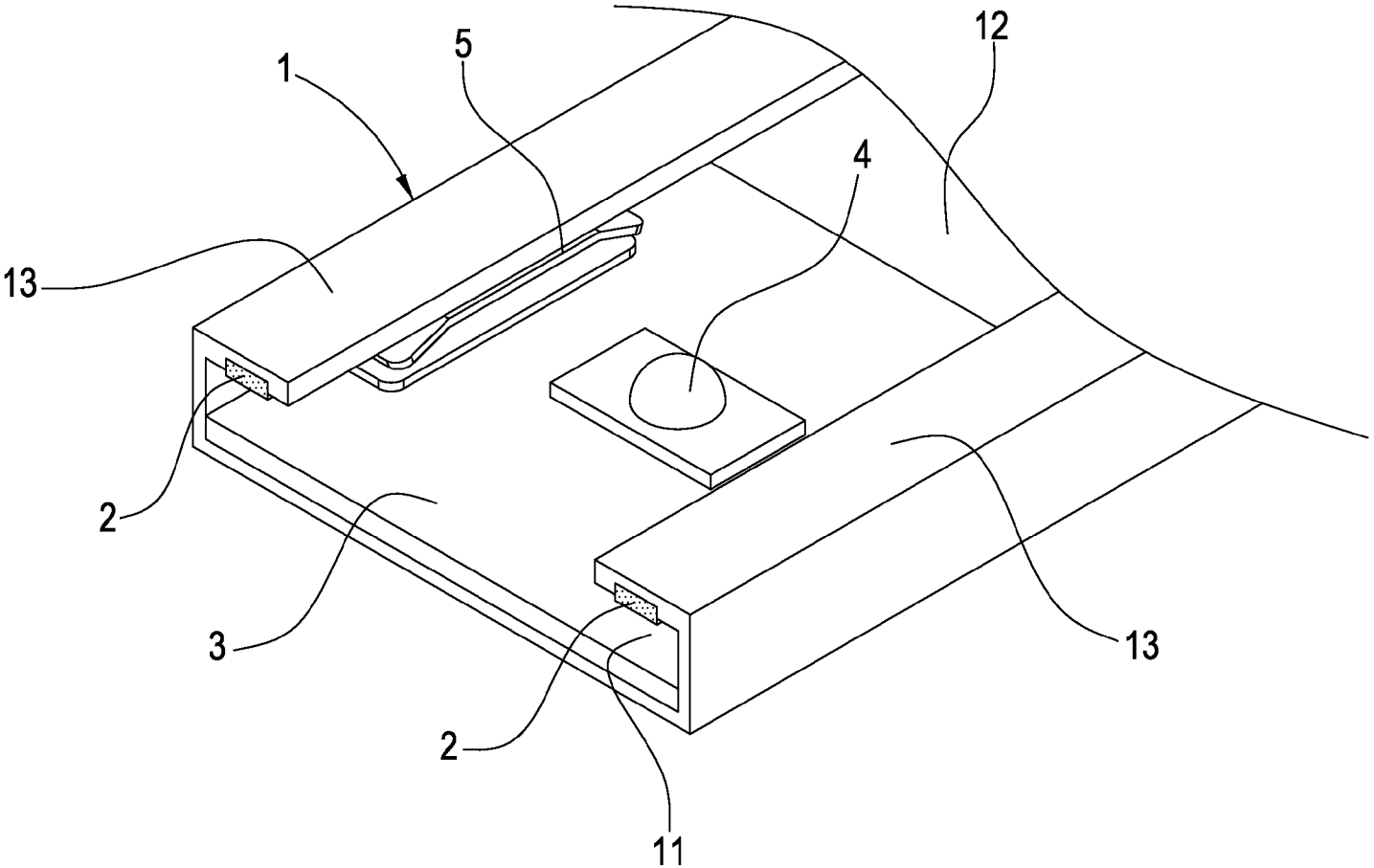
FIG. 2 is a perspective view showing the first embodiment of the LED assembly of the present invention in an assembled condition.
Figure 3:
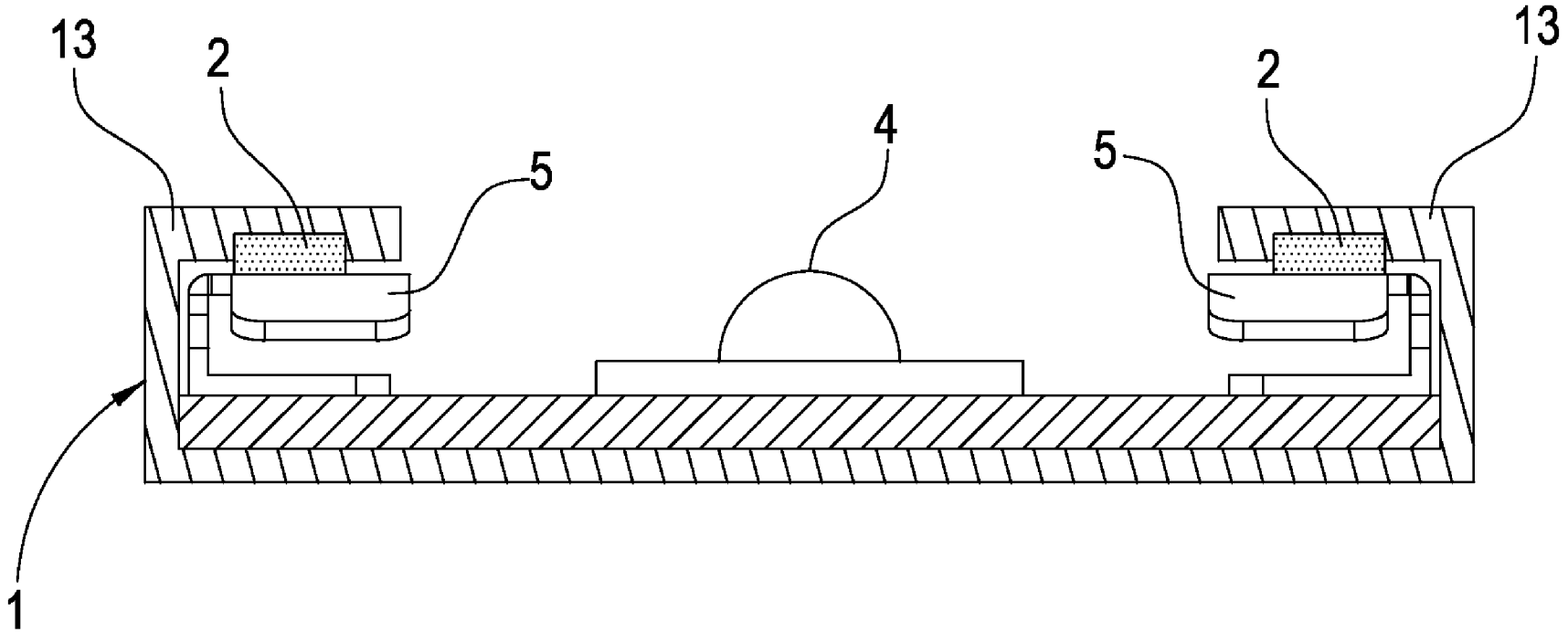
FIG. 3 is a cross-sectional view schematically illustrating the first embodiment of the LED assembly of the present invention.

Please see FIGS. 1, 2 and 3, which are the drawings schematically illustrating the first embodiment of the present invention. The improved LED assembly of the present invention comprises a frame 1 and a circuit substrate 3.

The frame 1 has a slot 11. The slot 11 has an opening 12 on its upper surface. An elongated inverted L-shaped structure 13 is formed on either side of the opening 12. One or more conductive strips 2 are formed on the inner side of the elongated inverted L-shaped structure 13. The positive lead of a power source is connected with some of the conductive strips 2, and the negative lead of the power source is connected with the other conductive strips 2. Preferably, there are two or more conductive strips 2.

The circuit substrate 3 has one or more light-emitting units 4 and two or more conductive strips 5. These conductive strips 5 may engage with the conductive strips 2 of the frame 1, and the number of the former is the same with that of the latter. In addition, these conductive strips 5 are of the form of leaf spring or flexible strip; one of the conductive strips 5 is connected to the positive prong of the light-emitting unit 4 and the other conductive strip 5 is connected to the negative prong of the light-emitting unit 4 through connective wire or circuit design.

In assembly, the circuit substrate 3 is slid into the slot 11 of the frame 1 so that the light-emitting unit 4 is moved into the opening 12 and is fully exposed. In addition, each of the conductive strips 5 is engaged with the corresponding conductive strip 2 located on the inner side of the upper wall of the elongated inverted L-shaped structure 13. Therefore, electricity from the electric source may be supplied from the source through the conductive strip 2 and the conductive strip 5 and then to the light-emitting unit 4 so that the light-emitting unit 4 may be powered up and emit light. As a plurality of circuit substrates 3 are slid into the slot 11 of the frame 1, the light-emitting unit 4 of each of the circuit substrates 3 may be electrically connected with the conductive strips 2 and may emit light through the opening 12. Therefore, the goals of illumination and fast assembly may be reached.

Figure 4:
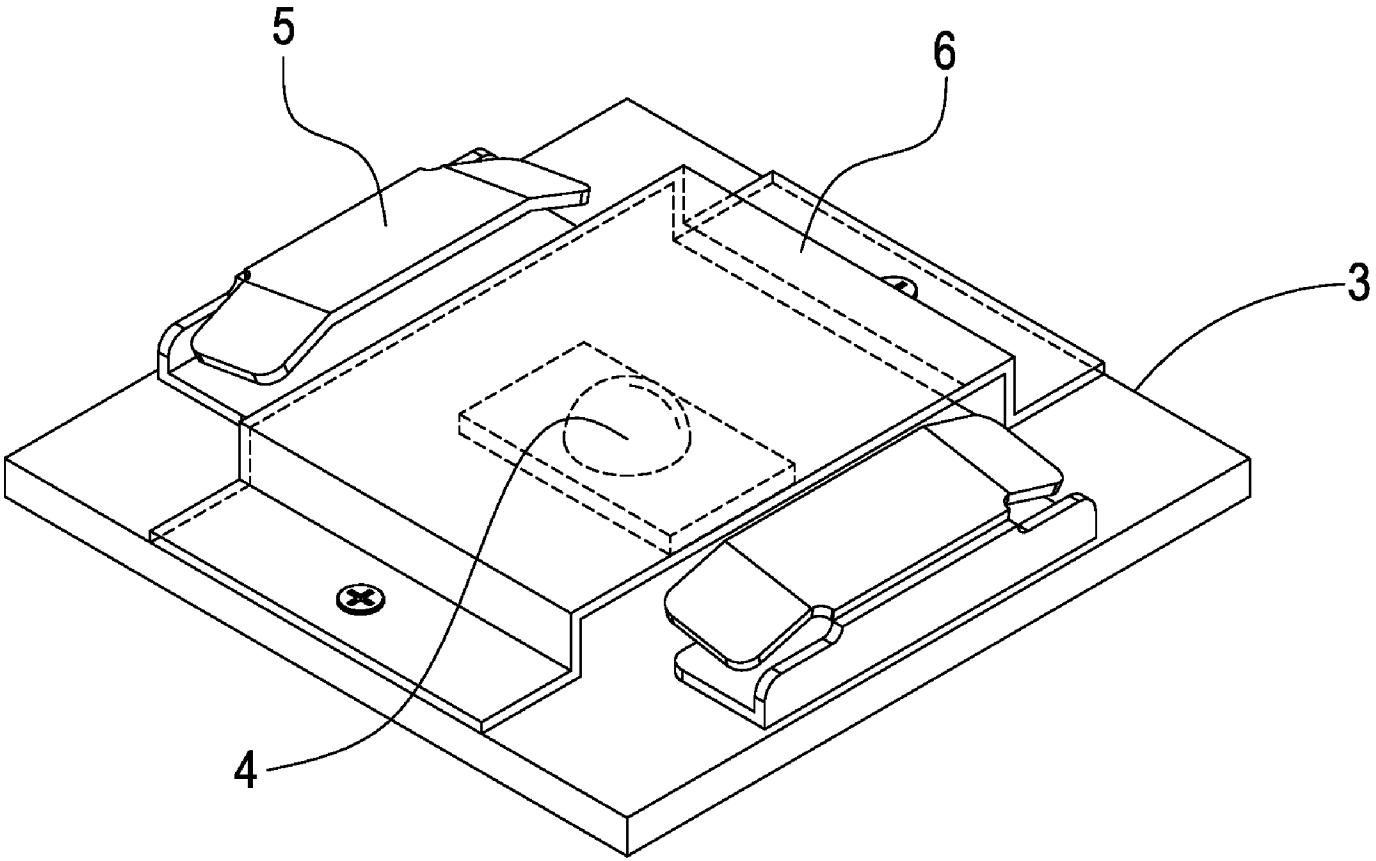
FIG. 4 is a perspective view showing that a cover may be used for the circuit substrate in the first embodiment of the present invention.

Please refer to FIG. 4, which illustrates an embodiment of the circuit substrate 3 of the present invention. A cover 6 may be used to cover the light-emitting unit 4 to protect it from bumping and damages.

Figure 5:
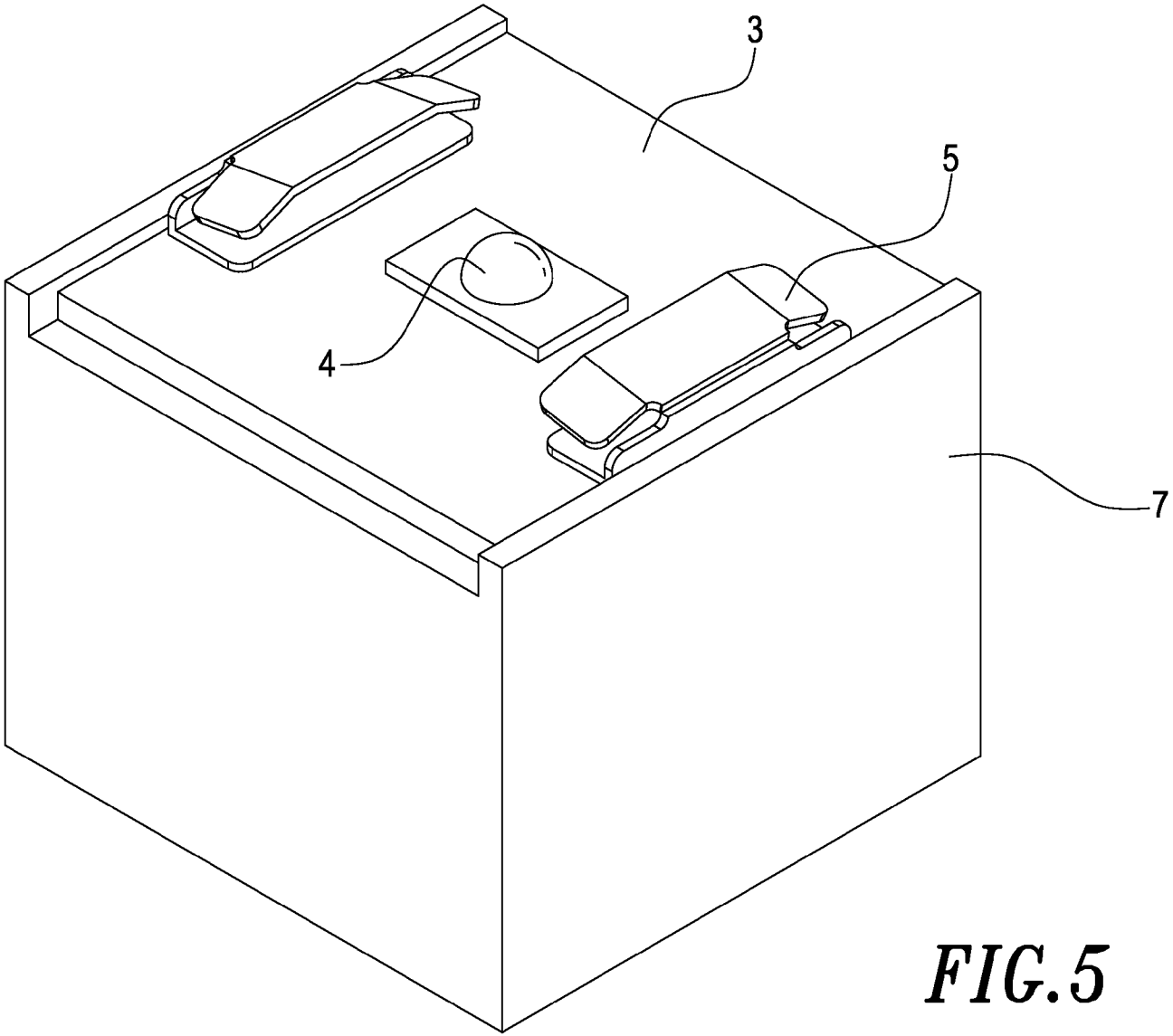
FIG. 5 is a perspective view showing that a heat-dissipating unit may be fitted under the circuit substrate.

Now, please see FIG. 5, which illustrates another embodiment of the circuit substrate 3 of the present invention. A heat-dissipating unit 7 may be fitted under the circuit substrate 3 so that heat generated by each light-emitting unit 4 may be channeled to heat-dissipating unit 7 so that heat may be dissipated effectively and so as to protect the light-emitting unit 4 from overheating.

Figure 6:
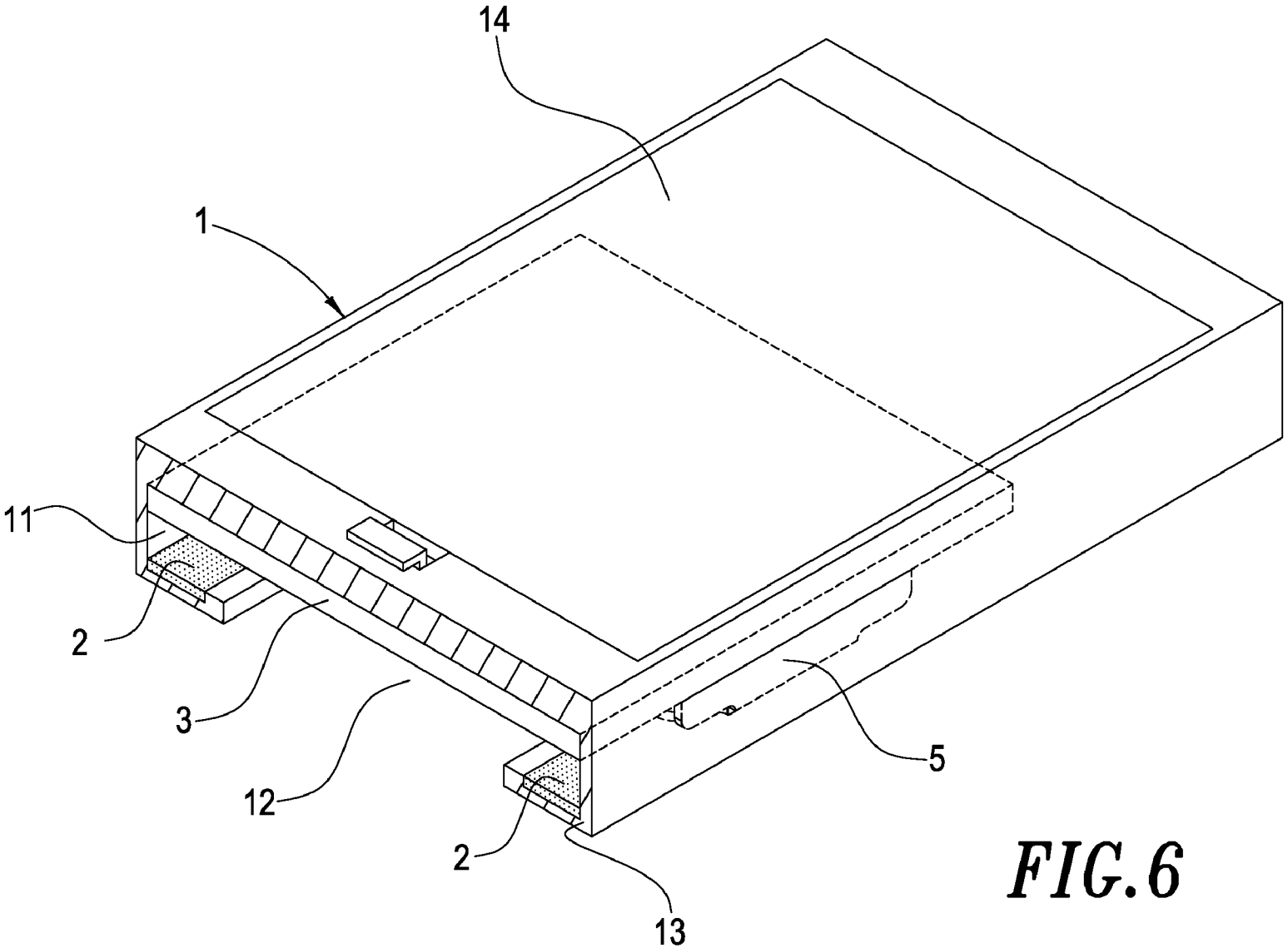
FIG. 6 is a perspective view showing the second embodiment of the LED assembly of the present invention.

Please refer to FIG. 6, which illustrates a second embodiment of the present invention. An opening is formed on the frame 1. In assembly, the circuit substrate 3 containing the light-emitting units and conductive strips may be fitted onto the frame 1 through the slot 11 so that the conductive strips 5 may be engaged with the conductive strips 2 of the frame 1. A flat cover 14 may be used to seal off the opening and to press the conductive strips 5 downwards so as ensure the electrical contact between each conductive strip 5 and the corresponding conductive strip 2.

Figure 7:
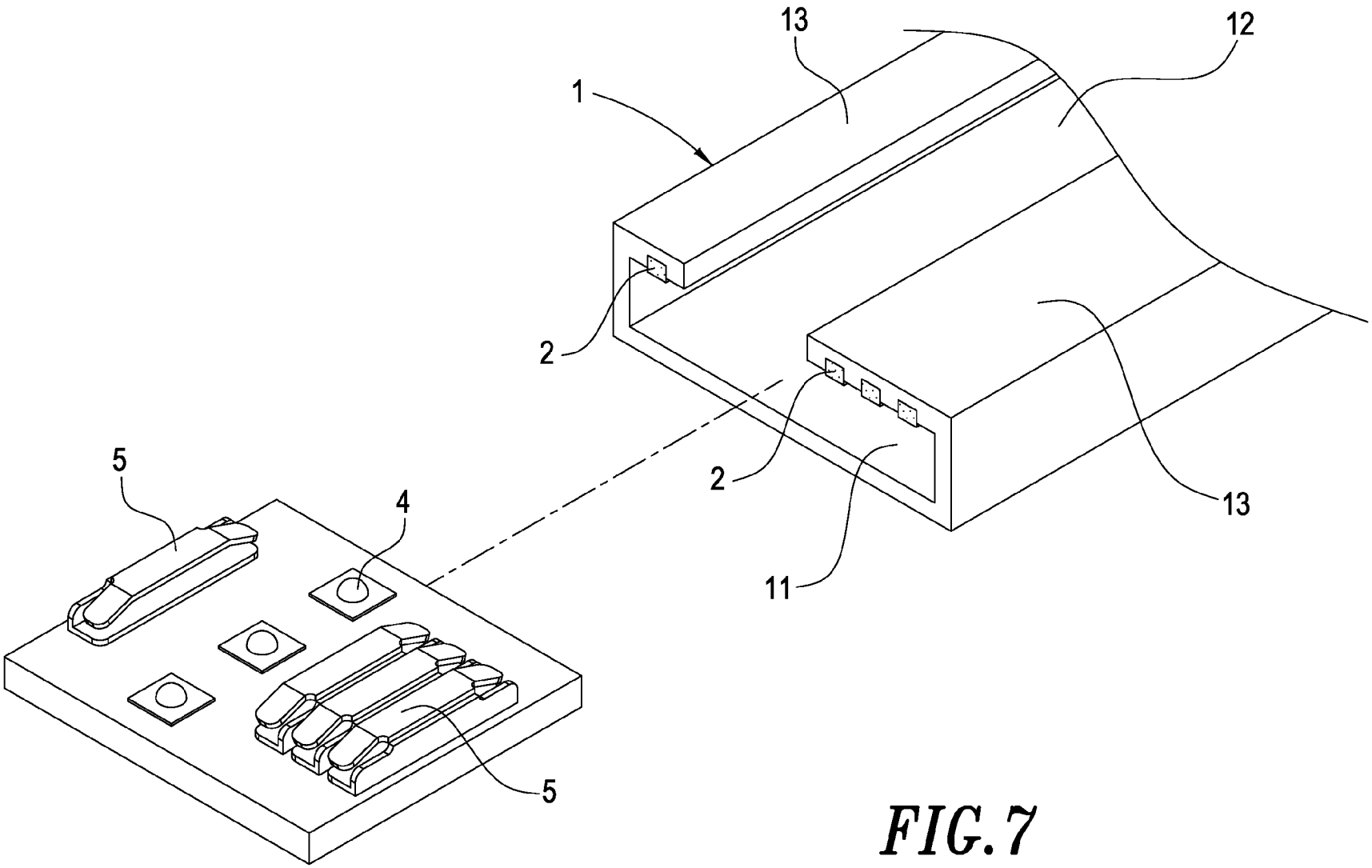
FIG. 7 is a perspective view showing how the circuit substrate is fitted onto the frame in the third embodiment of the present invention.
Figure 8:
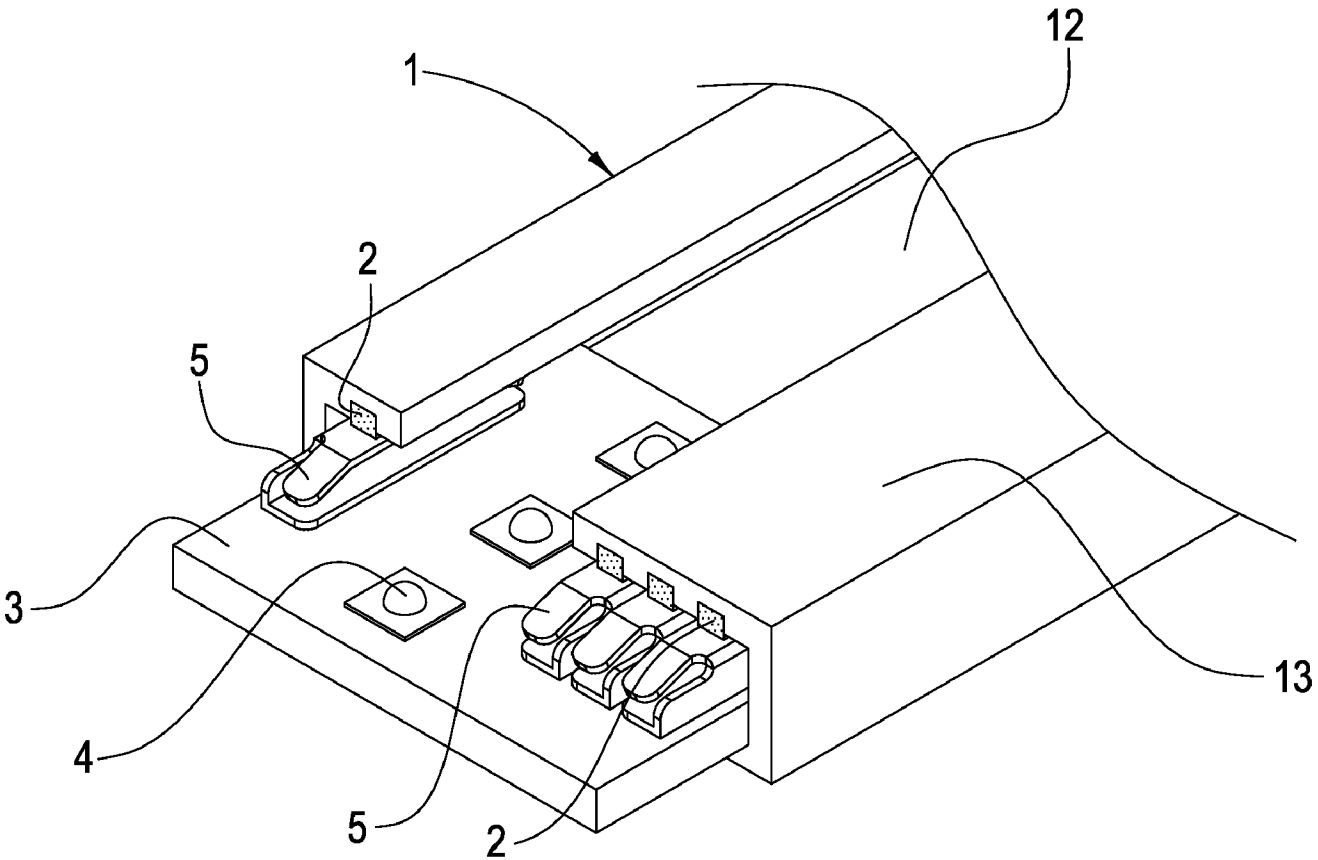
FIG. 8 is also a perspective view showing how the circuit substrate is fitted onto the frame in the third embodiment of the present invention.

Please refer to FIGS. 7 and 8, which illustrate a third embodiment of the present invention. In contrast to the first embodiment illustrated in FIG. 1, three light-emitting units 4 (emitting red, green and blue light) and four conductive strips 5 are disposed on the circuit substrate 3. One of the four conductive strips 5 is connected to the positive prongs of the three light-emitting units 4 through connective wire or circuit design, and the other three conductive strips 5 are connected to the negative prong of the corresponding light-emitting unit 4 through a connective wire. The elongated inverted-L-shaped structure 13 has four conductive strips 2 that may align and engage with the conductive strips 5. One of the four conductive strips 2 is connected with the positive lead of the electric source, while the other three conductive strips 2 are connected with the negative lead of the electric source. In assembly, the circuit substrate 3 is slid into the slot 11 of the frame 1, and the four conductive strips 5 may engage with the four conductive strips 2 of the frame 1. In use, a user may power up or switch on one or two or three of these three light-emitting units 4 by the control of the current flow. For example, one of the three light-emitting units 4 may be lit; also, two of them may be switched on simultaneously. Other parts of the third embodiment of the present invention are the same with those of the first embodiment illustrated in FIG. 1.

Although the third embodiment of the present invention (as illustrated in FIGS. 7 and 8) has been described, it should be understood that the third embodiment is to be regarded in an illustrative manner rather than a restrictive manner. For example, the numbers of the light-emitting units 4, conductive strips 2 and conductive strips 5 may be changed according to the actual need. Also, the negative leads of several light-emitting units 4 may be connected with a single conductive strip 5 and the positive leads of them may be connected with a plurality of conductive strips 5. In this manner, a user may turn on one, two, three, four, etc. or all of these light-emitting units 4.

The frame 1 may be made of a metallic material, and the conductive strips 2 should be electrically insulated from the frame 1 so as to allow the heat generated by the light-emitting units 4 to be passed to the frame 1 and then to dissipate into the ambient air after the circuit substrate 3 is fitted onto the frame 1 (so that the circuit substrate 3 is in contact with the inner wall of the frame 1).

Alternatively, the frame 1 may be made of a plastic material.

Figure 9:
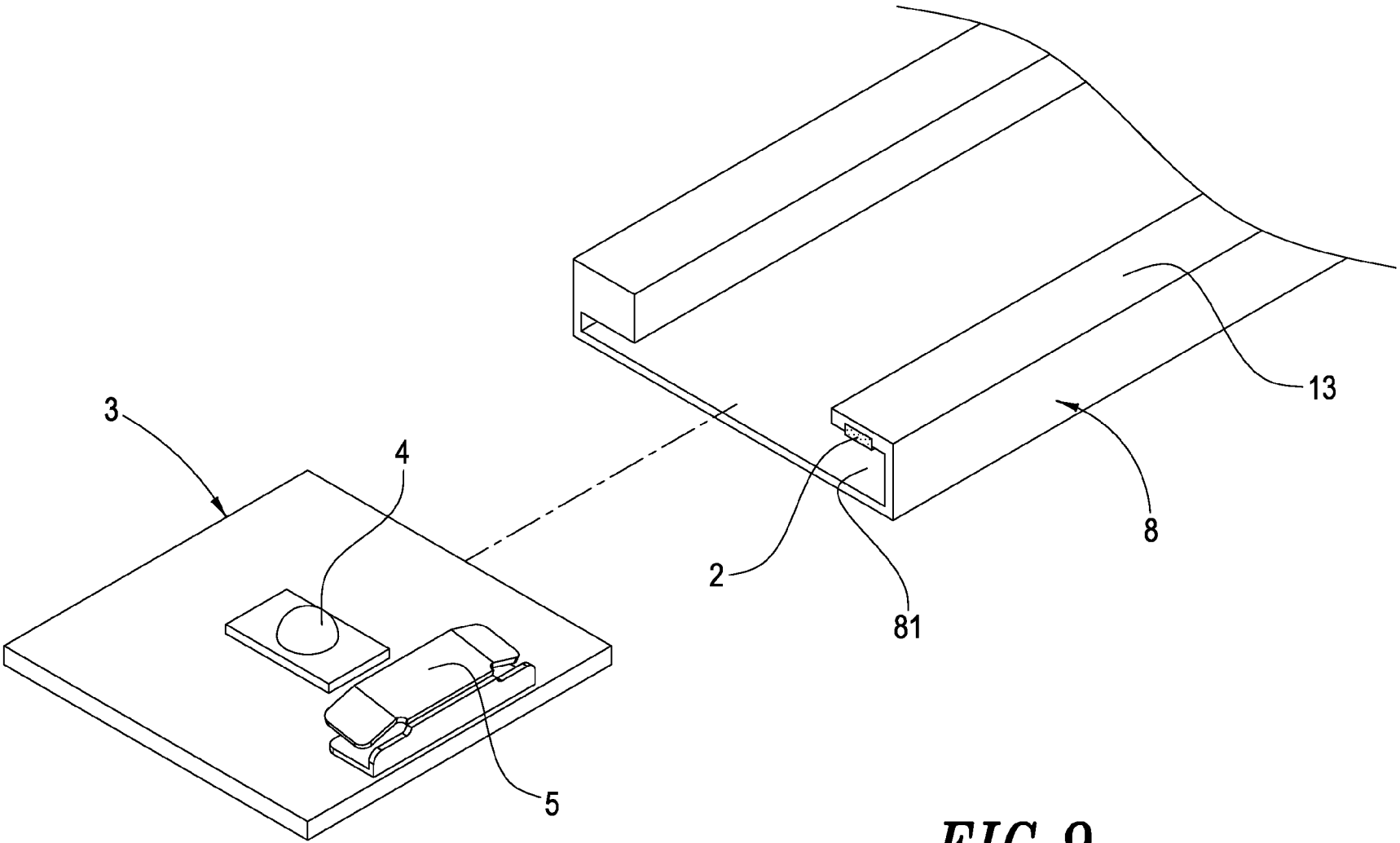
FIG. 9 is also a perspective view showing how the circuit substrate is fitted onto the frame in the fourth embodiment of the present invention.

Please refer to FIG. 9, which illustrates a fourth embodiment of the present invention. The frame 8 is made of a metallic material and has a conductive strip 2, which should be electrically insulated from the frame 8 to avoid short circuit. The conductive strip 2 is connected with the positive lead of the electric source, while the metallic frame 8 is connected with the negative lead of the electric source. The circuit substrate 3 has one conductive strip 5. The positive leads of one or more light-emitting units 4 are connected with the conductive strip 5 and the negative leads of them are connected with the circuit substrate 3 through connective wire or circuit design. In assembly, the circuit substrate 3 is slid into the slot 81 of the frame 8; therefore, the circuit substrate 3 may be engaged with the frame 8, and the conductive strip 5 may be engaged with the conductive strip 2 the frame 8. Therefore, electricity from the electric source may be supplied from the source through the conductive strip 2 and the metallic frame 8 and then to the conductive strip 5 and the circuit substrate 3 so that the light-emitting units 4 may be powered up and emit light. In addition, a plurality of conductive strips 5 may be used, and how the light-emitting units 4 are connected with the conductive strips 5 may be the same as that used in the third embodiment (as illustrated in FIG. 7). Therefore, in this manner, a user may turn on one, two, three, four, etc. or all of these light-emitting units 4.

In addition, the conductive strips 2 may be disposed on other places of the frame 1, 8 besides the inner side of the elongated inverted L-shaped structure 13 so long as these conductive strips 2 may be engaged with the conductive strips 2 of the frame 1, 8 after the circuit substrate 3 is slid into the frame 1.

Figure 10:
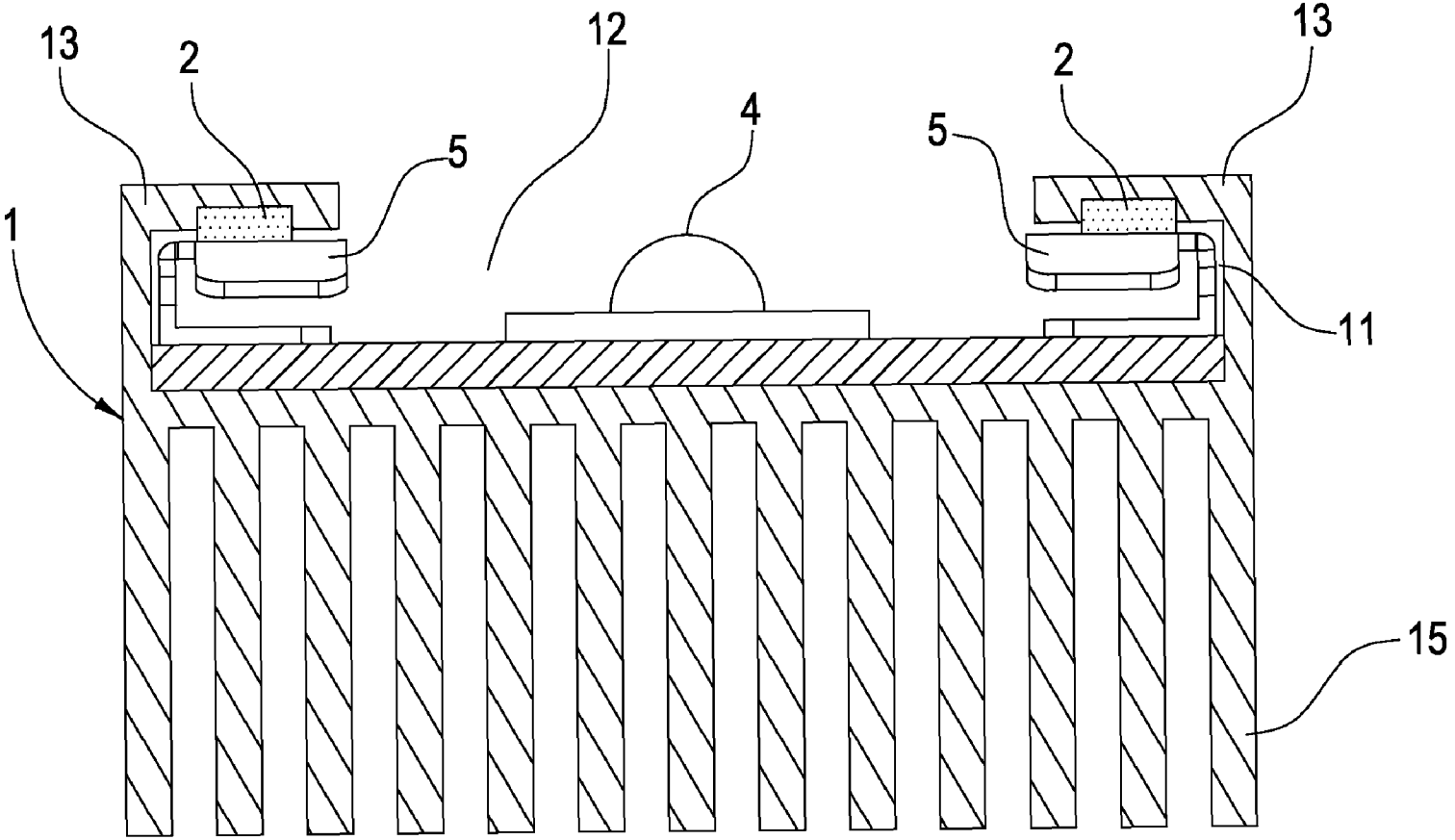
FIG. 10 is a cross-sectional view schematically illustrating the fifth embodiment of the present invention.

Please refer to FIG. 10, which illustrates a fifth embodiment of the present invention. If the frame 1 is made of a metallic material, several heat-dissipating protrusions 15 extending from the frame 1 may be used so that heat may be dissipated from the frame 1 effectively. Other parts are the same as those of the first embodiment illustrated in FIG. 1.

Figure 11:
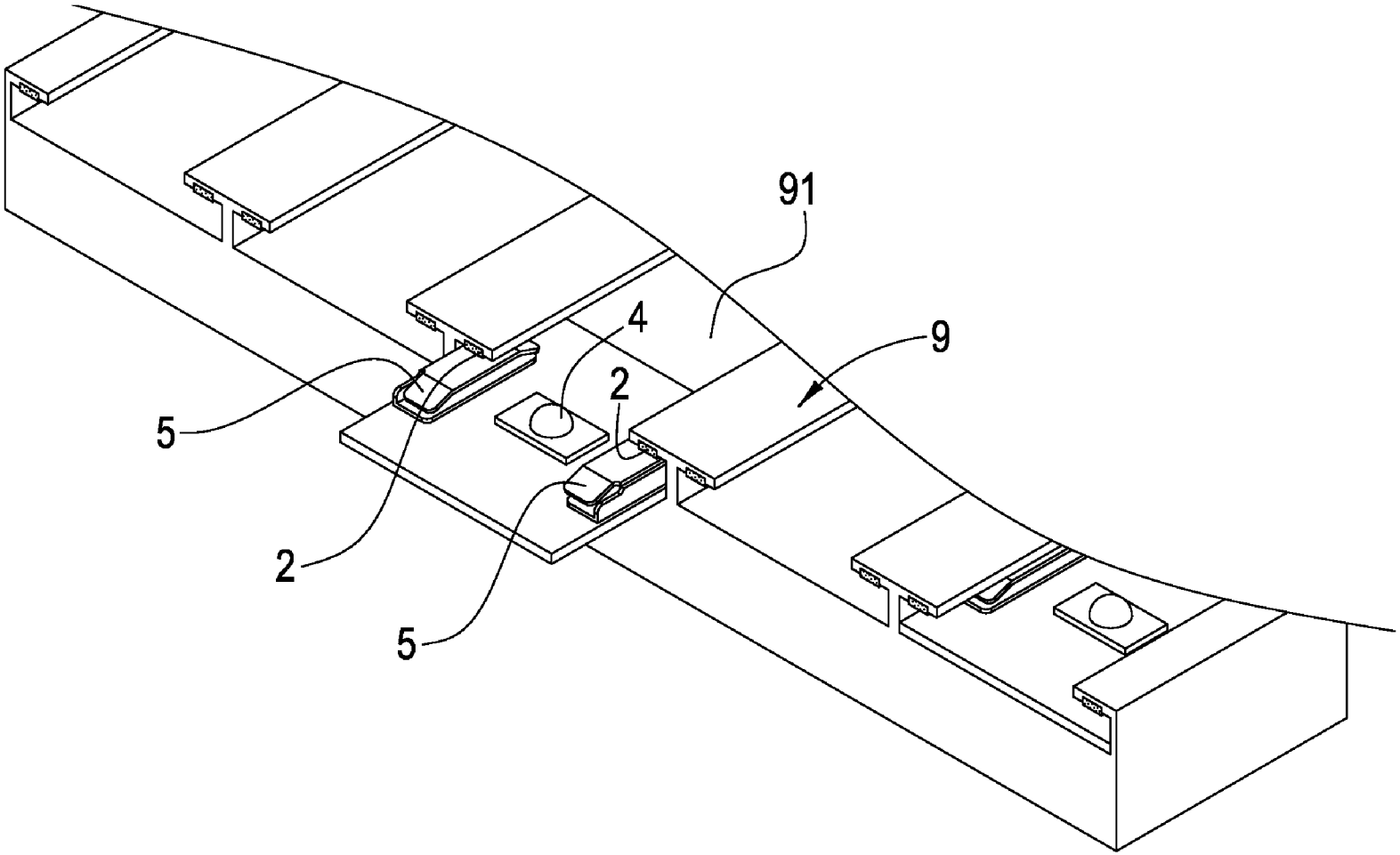
FIG. 11 is also a perspective view showing the sixth embodiment of the present invention.

Please refer to FIG. 11, which illustrates a sixth embodiment of the present invention. A plurality of slots 91 may be disposed on the frame 9 so that one or more circuit substrates 3 containing the light-emitting units 4 and conductive strips 5 may be slid into the frame 9 in assembly. In addition, other parts of the frame 9 and the structure of the circuit substrates 3 are the same of those of the first embodiment illustrated in FIG. 1.

The light-emitting units 4 described in any of the aforementioned six embodiments may be LEDs or OLEDs.

Also, one or more light-emitting units 4 may be disposed on the circuit substrate 3 according to the size of the circuit substrate 3.

Furthermore, a user may decide the number of the circuit substrates 3 according to his illumination need.

In contrast to the LED assembly of the prior art, the LED assembly of the present invention has the following advantages:

1. The frame has a slot, and one or more conductive strips are formed on the inner side of the elongated inverted L-shaped structure. The conductive strips are connected with a power source and may be engaged with the conductive strips disposed on the circuit substrate. In assembly, the circuit substrate is slid into the slot of the frame so that each of the conductive strips of the circuit substrate is engaged with the corresponding conductive strip of the frame. Therefore, electricity from the electric source may be fed from the source through the conductive strip of the frame and the conductive strip of the circuit substrate and then to the light-emitting units so that each of the light-emitting units may be powered up and emit light. Consequently, the goal of easy and fast assembly may be reached.

2. The LED assembly of the present invention has the advantages of simple structure, easy assembly and high usefulness.

Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An improved LED assembly, comprising:
a frame comprising
a slot having an opening on the upper surface of the frame;
an elongated inverted L-shaped structure being formed on either side of the opening;
one or more conductive strips being formed on the inner side of the elongated inverted L-shaped structure;
some of the conductive strips being connected to a positive lead of a power source; and
the other conductive strips being connected to a negative lead of the power source so that electricity may be supplied from the power source to the conductive strips, and
a circuit substrate comprising
one or more light-emitting units;
two or more conductive strips;
some of the conductive strips of the circuit substrate being connected to positive prongs of the light-emitting units and the other conductive strips of the circuit substrate being connected to negative prongs of the light-emitting units through connective wire or circuit design; and
in assembly, the circuit substrate being slid into the slot of the frame and each of the conductive strips of the circuit substrate being engaged with a corresponding conductive strip of the frame,
wherein both the conductive strips of the frame and the conductive strips of the circuit substrate are of the form of leaf spring or flexible strip.

2. The improved LED assembly as in claim 1, wherein conductive strips connected to the positive lead and negative lead of a power source are formed on the inner side of the elongated inverted L-shaped structure of the frame and two conductive strips are disposed on the circuit substrate so that electricity may be supplied to the two conductive strips of the circuit substrate.

3. The improved LED assembly as in claim 1, wherein the positive prong and negative prong of the light-emitting unit are connected to the conductive strips of the circuit substrate through connective wire.

4. The improved LED assembly as in claim 1, wherein the positive prong and negative prong of the light-emitting unit are connected to the conductive strips of the circuit substrate through circuit design.

5. The improved LED assembly as in claim 1, wherein a heat-dissipating unit may be fitted under the circuit substrate so that heat may be dissipated effectively and swiftly.

6. The improved LED assembly as in claim 1, wherein a cover may be used to cover the light-emitting unit to protect it from bumping and damages.

7. The improved LED assembly as in claim 1, wherein the circuit substrate is made of aluminum.

8. An improved LED assembly, comprising:
a metallic frame comprising
a slot having an opening on the upper surface of the frame;
an elongated inverted L-shaped structure being formed on either side of the opening;
one or more conductive strips being formed on the inner side of the elongated inverted L-shaped structure;
the conductive strips being electrically insulated from the metallic frame;
the conductive strips being connected to a positive lead of a power source; and
the metallic frame being connected to a negative lead of the power source, and
a circuit substrate comprising
one or more light-emitting units;
two or more conductive strips;
the conductive strips of the circuit substrate being connected to positive prongs of the light-emitting units;
the circuit substrate being connected to negative prongs of the light-emitting units; and
in assembly, the circuit substrate being slid into the slot of the frame and each of the conductive strips of the circuit substrate being engaged with a corresponding conductive strip of the frame,
wherein both the conductive strips of the frame and the conductive strips of the circuit substrate are of the form of leaf spring or flexible strip.

9. The improved LED assembly as in claim 8, wherein the conductive strips of the frame are formed on the inner side of the elongated inverted L-shaped structure.

10. The improved LED assembly as in claim 8, wherein a conductive strip is formed on the inner side of the elongated inverted L-shaped structure and a conductive strip is disposed on the circuit substrate.

11. The improved LED assembly as in claim 8, wherein the positive prong and negative prong of the light-emitting unit are connected to the conductive strips of the circuit substrate through connective wire.

12. The improved LED assembly as in claim 8, wherein the positive prong and negative prong of the light-emitting unit are connected to the conductive strips of the circuit substrate through circuit design.

13. The improved LED assembly as in claim 8, wherein a heat-dissipating unit may be fitted under the circuit substrate so that heat may be dissipated effectively and swiftly.

14. The improved LED assembly as in claim 8, wherein a cover may be used to cover the light-emitting unit to protect it from bumping and damages.

15. The improved LED assembly as in claim 8, wherein the circuit substrate is made of aluminum.

16. The improved LED assembly as in claim 8, wherein several heat-dissipating protrusions extending from the metallic frame may be used.

* * * * *